US011656023B2

(12) United States Patent
Pendyala

(10) Patent No.: US 11,656,023 B2
(45) **Date of Patent: *May 23, 2023**

(54) HANDLE ASSEMBLY

(71) Applicant: WHIRLPOOL CORPORATION, Benton Harbor, MI (US)

(72) Inventor: Supreeth Pendyala, Telangana (IN)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/708,787

(22) Filed: Mar. 30, 2022

(65) Prior Publication Data

US 2022/0221217 A1 Jul. 14, 2022

Related U.S. Application Data

(63) Continuation of application No. 16/733,968, filed on Jan. 3, 2020, now Pat. No. 11,300,351.

(51) Int. Cl.
*E05B 1/00* (2006.01)
*F25D 23/02* (2006.01)

(52) U.S. Cl.
CPC ..... *F25D 23/028* (2013.01); *E05B 1/0015* (2013.01); *F25D 2323/02* (2013.01)

(58) Field of Classification Search
CPC ... Y10T 16/458; Y10T 16/498; Y10T 16/513; Y10T 16/24; Y10T 29/49826; Y10T 29/49876; Y10T 29/49947; Y10T 29/49948; Y10T 29/49963; Y10T 292/57; A47B 95/02; A47B 2095/023; E05B 1/00; E05B 1/0015; E05B 1/0053; E05B 1/028; E05B 85/10; E05B 79/06; F25D 23/02; F25D 23/028; F25D 2400/06; E05Y 2600/46; E05Y 2900/31
See application file for complete search history.

(56) References Cited

U.S. PATENT DOCUMENTS 3,648,411 A * 3/1972 Saunders ..... E05B 1/0015 49/460
4,066,285 A 1/1978 Hall et al.
4,087,141 A * 5/1978 Roberts ..... A47B 95/02 16/412
4,408,432 A 10/1983 Carter et al.
(Continued)

FOREIGN PATENT DOCUMENTS

CN 202500382 U 10/2012
DE 10259328 A1 7/2003
(Continued)

*Primary Examiner* — Chuck Y Mah
(74) *Attorney, Agent, or Firm* — Price Heneveld LLP

(57) ABSTRACT

A handle assembly for an appliance includes an elongate arcuate body with a grasping portion that has a first internal support rib and a forward wall that has a second internal support rib. The elongate arcuate body further defines a hollow profile. An insert is disposed within the hollow profile and includes at least one slot that receives at least one of the first internal support rib and the second internal support rib. An end cap is operably coupled to an end of the elongate arcuate body. At least one groove is defined at least in part by the forward wall.

18 Claims, 12 Drawing Sheets

(56) References Cited

U.S. PATENT DOCUMENTS

| | | | | |
|---|---|---|---|---|
| 4,926,523 | A * | 5/1990 | Carlson | F25D 23/028 16/412 |
| 4,952,127 | A | 8/1990 | Schmeisser et al. | |
| 5,144,718 | A | 9/1992 | Ozawa | |
| 5,797,164 | A | 8/1998 | Donaghy | |
| 6,546,597 | B2 | 4/2003 | Atalla et al. | |
| D610,595 | S | 2/2010 | Baker et al. | |
| 7,793,388 | B2 | 9/2010 | Wing | |
| 8,215,731 | B2 | 7/2012 | Drach et al. | |
| D714,366 | S | 9/2014 | Jeon et al. | |
| 9,009,969 | B2 | 4/2015 | Choi et al. | |
| 9,353,985 | B2 | 5/2016 | Oh et al. | |
| 9,366,471 | B2 | 6/2016 | Allen | |
| 2003/0079313 | A1 * | 5/2003 | Pohl | F25D 23/028 16/436 |
| 2006/0113312 | A2 | 6/2006 | Shin et al. | |
| 2006/0143865 | A1 | 7/2006 | Magyar et al. | |
| 2006/0200948 | A1 | 9/2006 | Steurer | |
| 2006/0207062 | A1 | 9/2006 | Wing | |
| 2008/0034553 | A1 | 2/2008 | Wing | |
| 2008/0313853 | A1 * | 12/2008 | Hale | A47B 95/02 29/700 |
| 2010/0005631 | A1 | 1/2010 | Drach et al. | |
| 2010/0287843 | A1 | 11/2010 | Oh | |
| 2012/0074826 | A1 | 3/2012 | Klaus et al. | |
| 2012/0280608 | A1 | 11/2012 | Park et al. | |
| 2014/0338152 | A1 | 11/2014 | Moody et al. | |

FOREIGN PATENT DOCUMENTS

| | | | | |
|---|---|---|---|---|
| DE | 102009026663 | A1 * | 12/2010 | E05B 1/0015 |
| DE | 102012004014 | A1 | 8/2013 | |
| EP | 3040660 | B1 | 5/2017 | |
| JP | 10311668 | A * | 11/1998 | |
| KR | 100893682 | B1 | 4/2009 | |
| KR | 2009051800 | A * | 5/2009 | |
| KR | 2010095980 | A * | 9/2010 | |
| KR | 101203265 | B1 | 11/2012 | |

* cited by examiner

HANDLE ASSEMBLY

CROSS-REFERENCE TO RELATED APPLICATION

This application is a continuation of U.S. Provisional application Ser. No. 16/733,968, filed on Jan. 3, 2020, now U.S. Pat. No. 11,300,351, entitled "HANDLE ASSEMBLY," the disclosure of which is hereby incorporated herein by reference in its entirety.

BACKGROUND OF THE DISCLOSURE

The present disclosure generally relates to an appliance, and more specifically, to a handle assembly for an appliance.

SUMMARY OF THE DISCLOSURE

According to one aspect of the present disclosure, a handle assembly for an appliance includes an elongate arcuate body with a grasping portion that has a first internal support rib and a forward wall that has a second internal support rib. The elongate arcuate body further defines a hollow profile. An insert is disposed within the hollow profile and includes at least one slot that receives at least one of the first internal support rib and the second internal support rib. An end cap is operably coupled to an end of the elongate arcuate body. At least one groove is defined at least in part by the forward wall.

According to another aspect of the present disclosure, an appliance includes a door and a handle assembly coupled to the door. The handle assembly includes a body that defines a hollow profile and has a rear grasping portion and a forward wall. A rib is defined on the forward wall within the body and a rib is defined on the rear grasping portion within the body. A metal insert is disposed within the hollow profile of the body. The metal insert defines slots configured to receive the ribs. An end cap is operably coupled to the ribs.

According to yet another aspect of the present disclosure, a handle assembly for an appliance includes an elongate arcuate body with a grasping portion that has an arcuate cross-section and a forward wall that together define a hollow profile. The elongate arcuate body further includes a first end and a second end. An insert is disposed at each of the first and second ends of the elongate arcuate body within the hollow profile. An end cap is operably coupled to each insert.

These and other features, advantages, and objects of the present disclosure will be further understood and appreciated by those skilled in the art by reference to the following specification, claims, and appended drawings.

Figure 1:
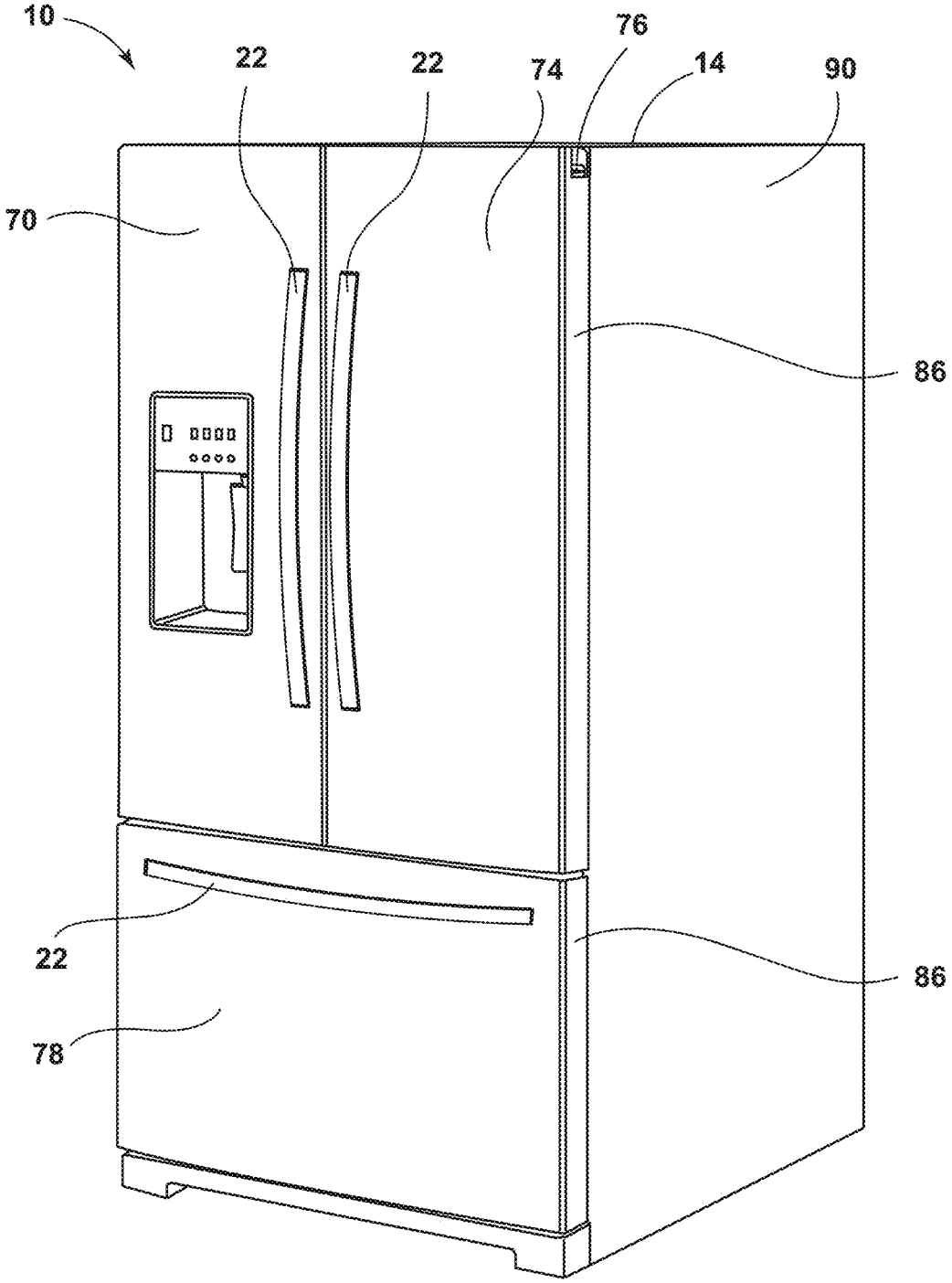
FIG. 1 is a side perspective view of an appliance of the present disclosure with doors and a bottom drawer in a closed position.
Figure 2:
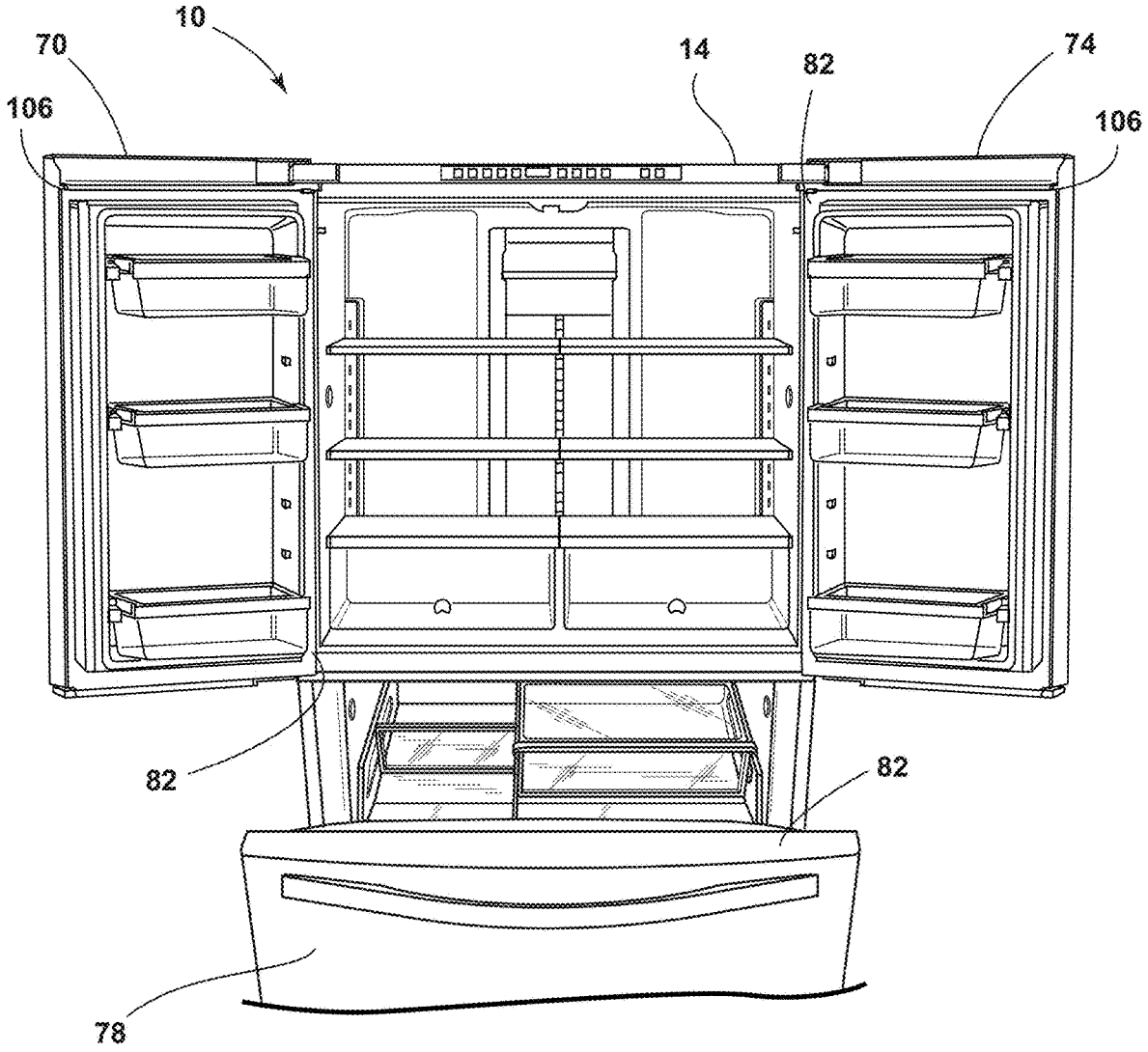
FIG. 2 is a partial front perspective view of the appliance of FIG. 1 with the doors and bottom drawer in an open position.
Figure 3:
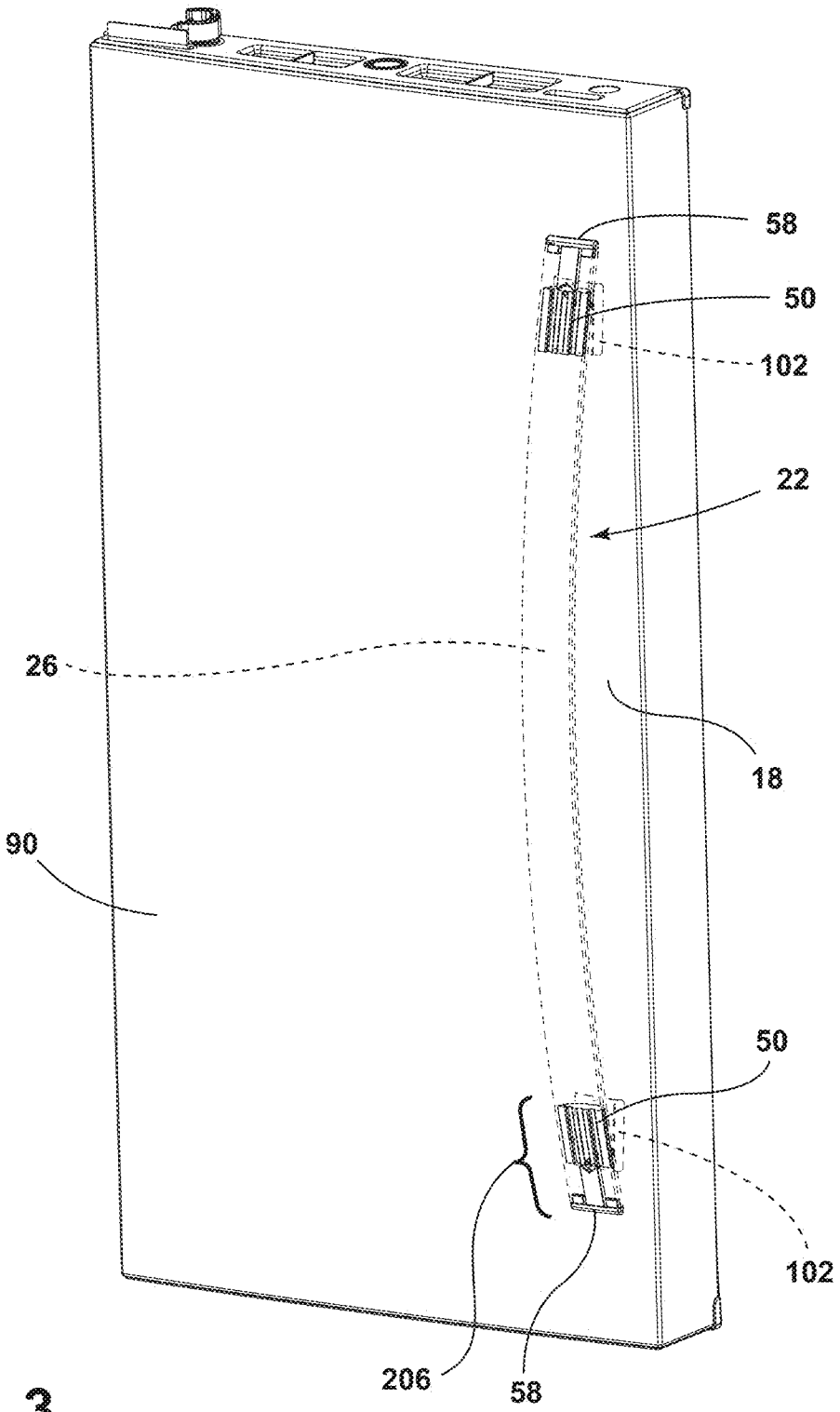
FIG. 3 is a side perspective view of a door and a handle assembly of the present disclosure.

The components in the figures are not necessarily to scale, emphasis instead being placed upon illustrating the principles described herein.

DETAILED DESCRIPTION

The present illustrated embodiments reside primarily in combinations of method steps and apparatus components related to a handle assembly. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a . . . " does not, without more constraints, preclude the existence of additional identical elements in the process, method, article, or apparatus that comprises the element.

Referring to FIGS. 1-12, reference numeral 10 generally designates an appliance that includes a cabinet 14. A door 18 is coupled to the cabinet 14, and a handle assembly 22 is coupled to the door 18. The handle assembly 22 includes a body 26 that defines a hollow profile 30 and has a rear grasping portion 34 and a forward wall 38. Ribs 42 are defined on the forward wall 38 within the body 26. A metal insert 50 is disposed within the hollow profile 30 of the body 26. The metal insert 50 defines slots 54 configured to receive the ribs 42, and an end cap 58 is operably coupled to the ribs 42.

Referring to FIGS. 1-4, the appliance 10 is illustrated as a French-door style refrigerator with a bottom-mounted drawer. However, it is also contemplated that the handle assembly 22 may be used in other various appliances that include, but are not limited to, refrigerators, freezers, coolers, ovens, dishwashers, laundry appliances, and other similar appliances and fixtures within household and commercial settings. The appliance 10 includes first and second doors 70, 74 hingedly coupled to the cabinet 14 via hinges 76 and a bottom drawer 78 operably coupled to the cabinet 14. As referenced herein, the term door 18 may refer to any one of the first and second doors 70, 74 as well as the bottom drawer 78. The handle assembly 22 is coupled to each of the first and second doors 70, 74 as well as the bottom drawer 78 so each is operable between open and closed positions 82, 86 by applying a force on the handle assembly 22. It is generally contemplated that the handle assembly 22 is vertically oriented on the first and second doors 70, 74, respectively, and is horizontally oriented on the bottom drawer 78. It is also contemplated that the handle assembly 22 may be oriented in any functional manner relative to the respective door 18.

In addition to the cabinet 14, the first and second doors 70, 74 and the bottom drawer 78 define an outer wrapper 90 of the appliance 10. The outer wrapper 90 may be formed from a metal, plastic, or other material typically used in the art. The outer wrapper 90, in relation to the door 18, defines holes 94 through which coupling features 98 extend to couple the handle assembly 22 to each respective door 18. The coupling features 98 are coupled to support plates 102 positioned on an inner surface 106 of the door 18 proximate to the respective holes 94. The support plates 102 are configured to receive a pulling force applied on the handle assembly 22 in particular during the opening of the door 18. The support plates 102 are at least partially coupled to the door 18 by a standard fastening member, such as a screw, rivet, bolt, or any other standard fastening member known in the art. The support plates 102 are coupled to the doors 18 by the coupling features 98 outwardly extend from the support plates 102 and through the door 18 to couple the handle assembly 22 to the door 18. In general, the coupling features 98 are also operably coupled to the metal insert 50, which is positioned within the body 26 of the handle assembly 22, discussed in further detail below.

Referring to FIGS. 3-6, the handle assembly 22 is typically coupled to the door 18 at two attachment points 108, which are defined by the location of the holes 94 and the support plates 102 relative to the respective door 18. Additionally, the attachment points 108 generally correspond to opposing ends 126 of the body 26 of the handle assembly 22. The body 26 extends between the two attachment points 108 to define a length L of the body 26. As illustrated, the body 26 generally bows along the length L relative to the outer wrapper 90. The bowing of the body 26 results in a generally arcuate shape, such that an arcuate central portion 114 of the body is defined between first and second ends 110, 112. In addition, the forward wall 38 similarly follows the bowed or arcuate shape of the body 26 from the first end 110 of the body 26 to the second end 112. It is generally contemplated that the first and second ends 110, 112 correspond to the opposing ends 126.

Typically, the forward wall 38 has a generally planar cross-section taken at any point along the length L of the body 26, such that an exterior surface 116 of the forward wall 38 is generally flat from a first side 118 to a second side 122 of the body 26. The body 26 is formed from a single, pultruded piece of material in that the outer and grasping portions 38, 34 are integrally formed and define the hollow profile 30 therebetween. While the forward wall 38 has a generally planar cross-section, the grasping portion 34 is rounded from the first side 118 to the second side 122 of the body 26 to define a generally parabolic cross-section. While the hollow profile 30 may be formed from a variety of manufacturing methods, it is generally contemplated that the hollow profile 30 may be formed by the pultrusion of the body 26. Pultrusion is a method in which a material is simultaneously pulled through a mold and extruded to define a shape and form. Thus, while the hollow profile 30 may be defined by the forward wall 38 and the grasping portion 34, each of the forward wall 38 and the grasping portion 34 may be defined by the removal of material in creating the hollow profile 30. However, it is also contemplated that the forward wall 38 may be coupled to the grasping portion 34 to then define the hollow profile 30 of the body 26.

In general, the forward wall 38 can have a decorative layer or finish, such that the forward wall 38 may be constructed to have a particular aesthetic appearance. The grasping portion 34 may be constructed to have a tactile feature 124 that can at least partially increase surface resistance between a user and the grasping portion 34. With the tactile feature 124, when a user grasps the body 26, the user can at least tactically distinguish the grasping portion 34 from the forward wall 38. By way of example, not limitation, the tactile feature 124 may be a textured material that resists slipping, such as rubber or silicon, to increase the user's grip on the body 26 of the handle assembly 22. While the tactile feature 124 may be a separate tactile material applied to the grasping portion 34, such as silicon, it is also contemplated that the tactile feature 124 may be a coating, a film, or any other material that minimizes the likelihood of the user's grip slipping from the grasping portion 34. Additionally or alternatively, the tactile feature 124 may be integrally formed with the grasping portion 34, such that the grasping portion 34 defines the tactile feature 124.

Referring to FIGS. 6-9B, each opposing end 126 of the body 26 generally define an oblique orientation 130 of the grasping portion 34, such that the grasping portion 34 tapers toward the respective end 126. An arcuate feature 134 of the grasping portion 34 is defined along the oblique orientation 130 and has an apex 138 that is oriented toward the arcuate central portion 114 (FIG. 5) of the body 26 and away from a base 142 of the arcuate feature 134. Extensions 146 project from the base 142 from which a ledge 150 extends along the length L (FIG. 5) of the body 26. A groove 154 is defined beneath the extensions 146 and the ledge 150. The groove 154 receives the end cap 58 and the metal insert 50, discussed in further detail below. The extensions 146 and the ledge 150 form a barrier that engages the end cap 58 when a pulling force is applied to the handle assembly 22. It is also contemplated that the metal insert 50 may have laterally extending flanges 156 positioned beneath the ledge 150 to at least partially retain the metal insert 50 within the hollow profile 30 of the body 26.

Figure 4:
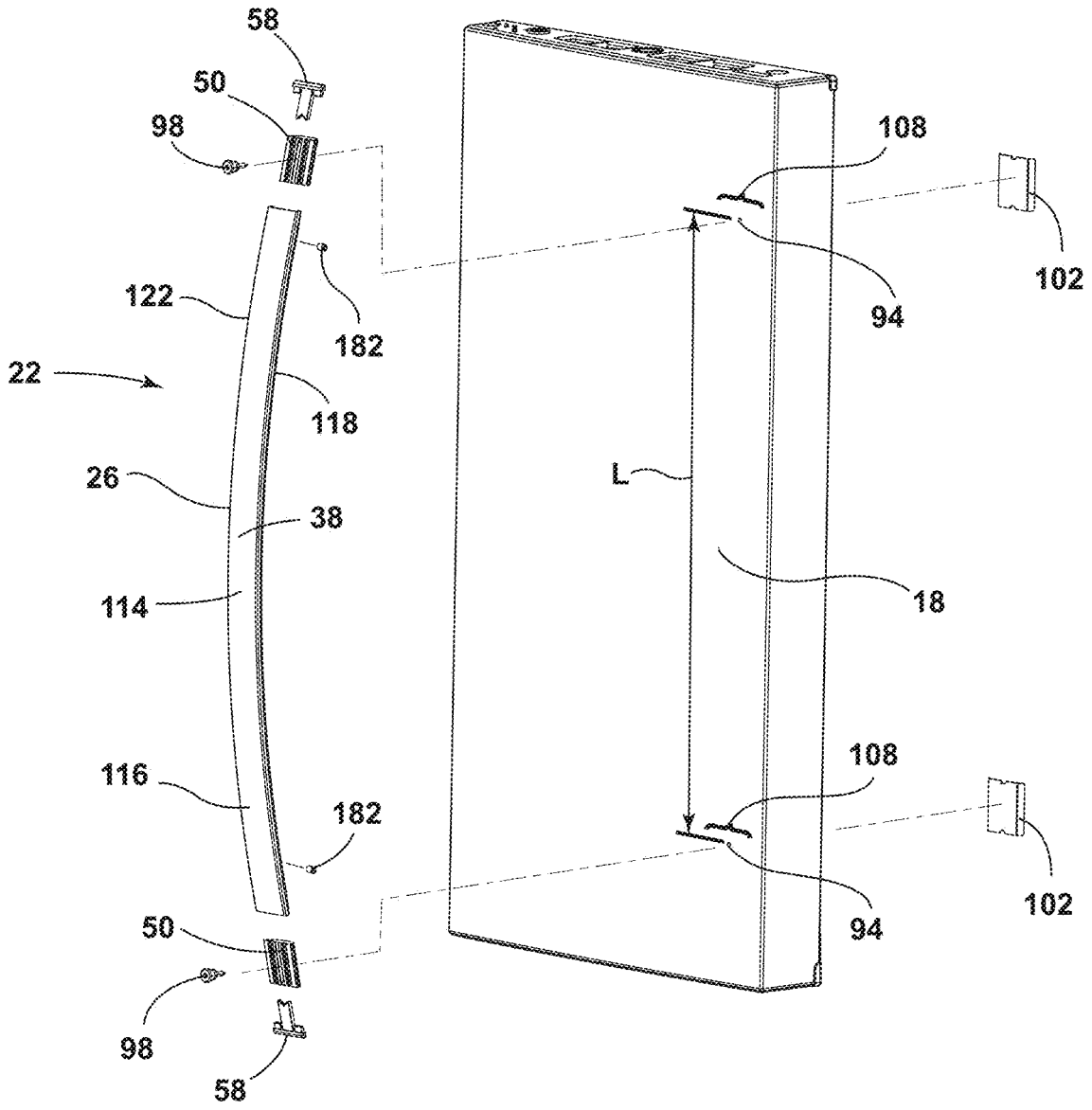
FIG. 4 is a side perspective enlarged view of a handle assembly and a door of the present disclosure.
Figure 5:
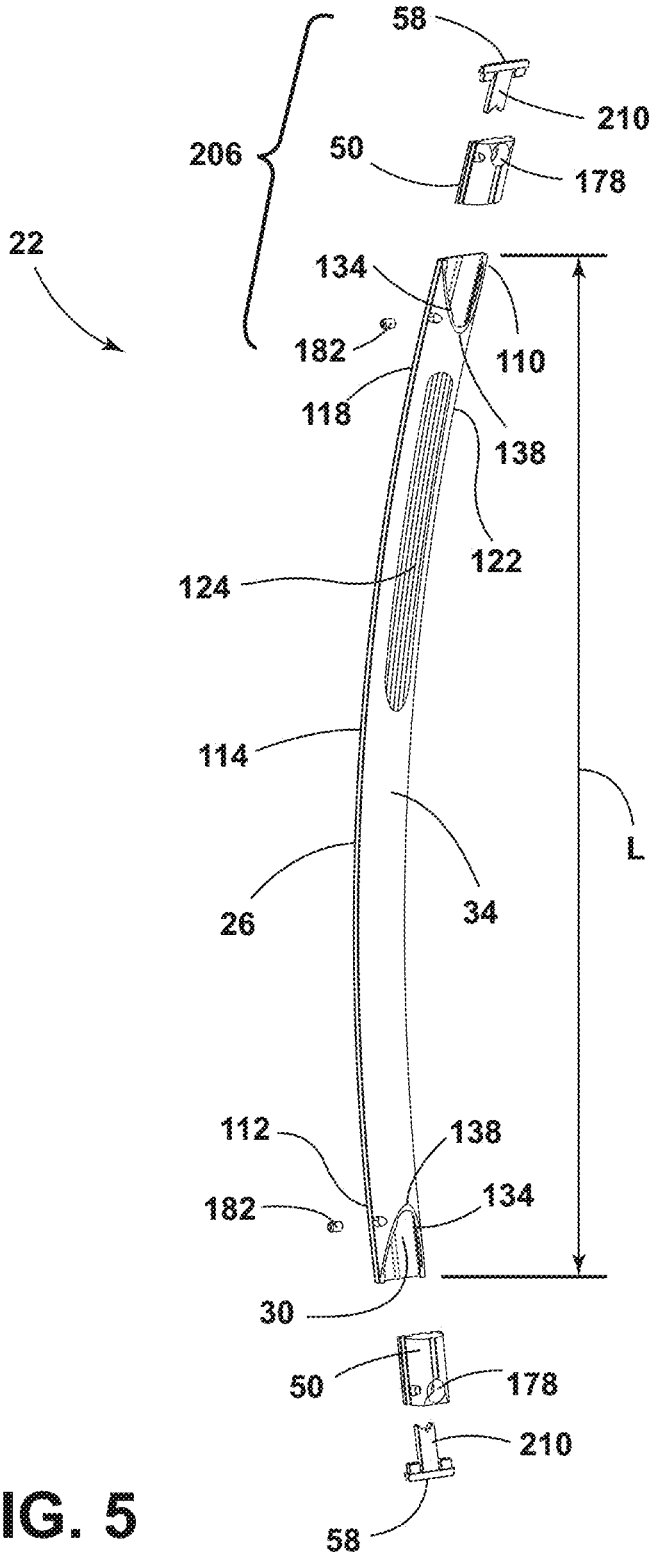
FIG. 5 is a side perspective enlarged view of a handle assembly of the present disclosure.
Figure 6:
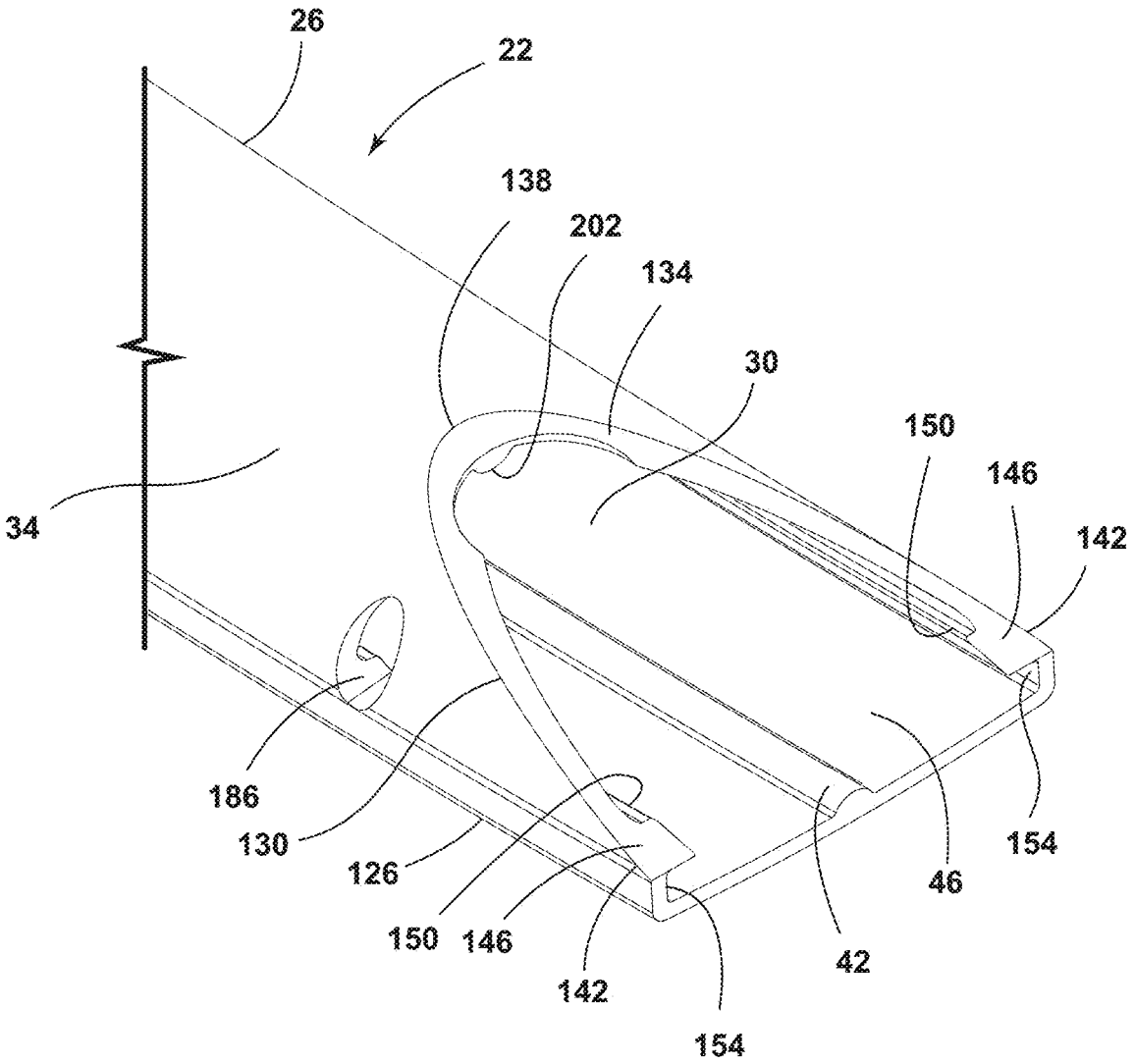
FIG. 6 is a partial side perspective view of a body of a handle assembly of the present disclosure.
Figure 7:
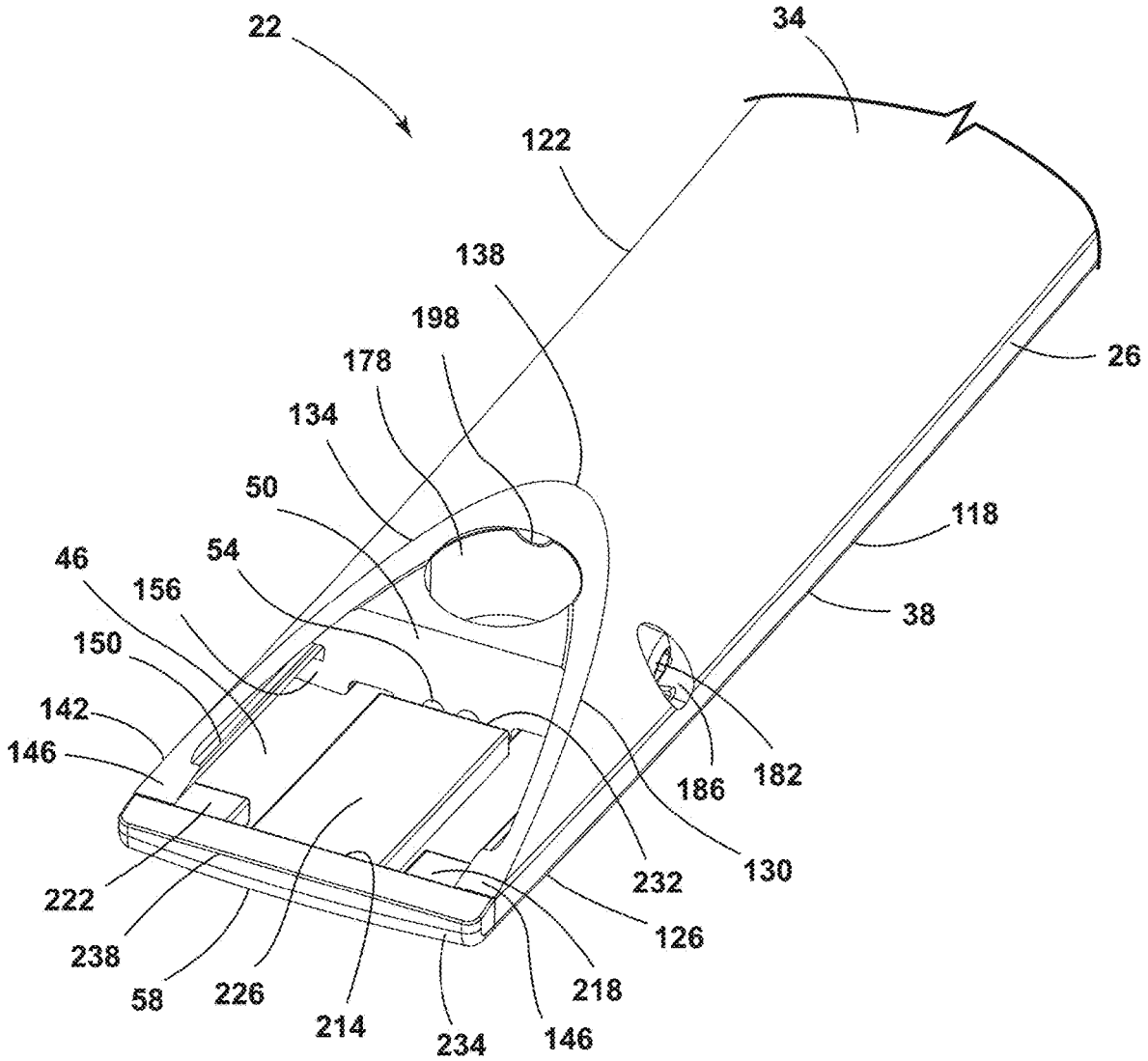
FIG. 7 is a partial enlarged view of an end of a handle assembly of the present disclosure.
Figure 8:
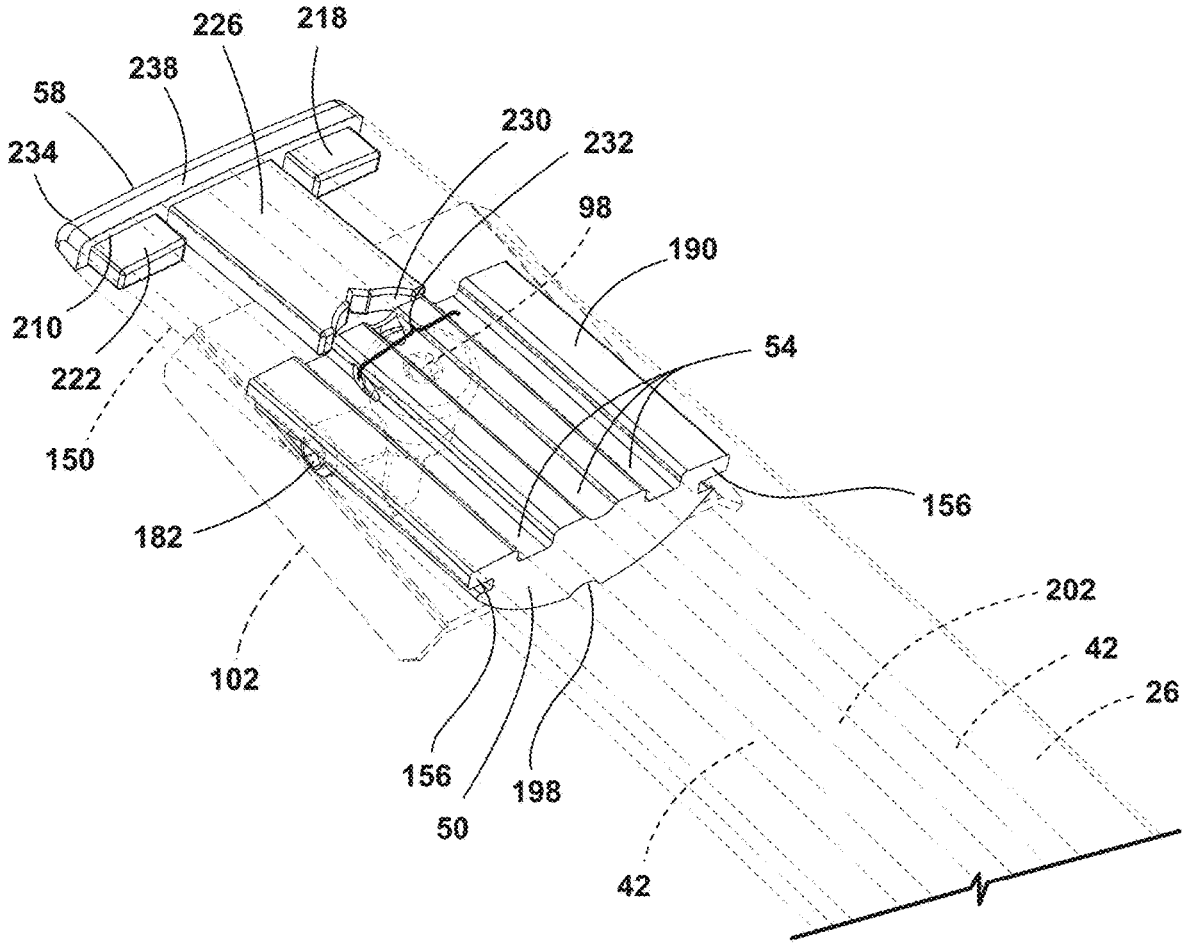
FIG. 8 is a partial enlarged view of a metal insert and an end cap of the present disclosure with a body of a handle assembly in phantom.
Figure 9A:
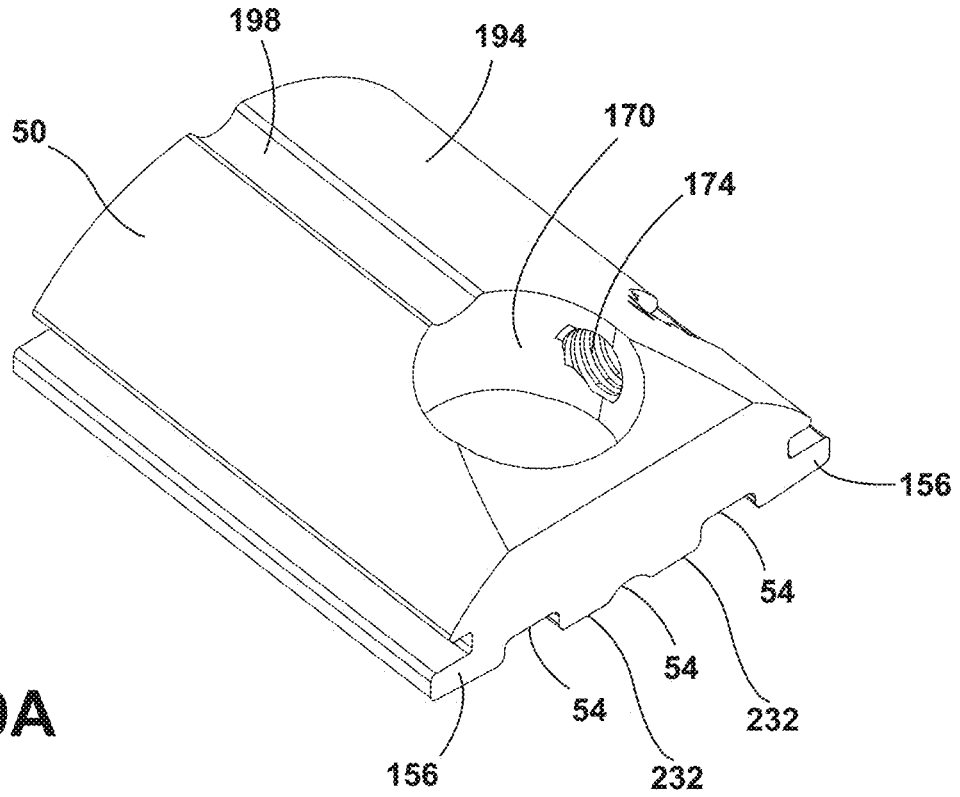
FIG. 9A is a bottom perspective view of a metal insert of the present disclosure.
Figure 9B:
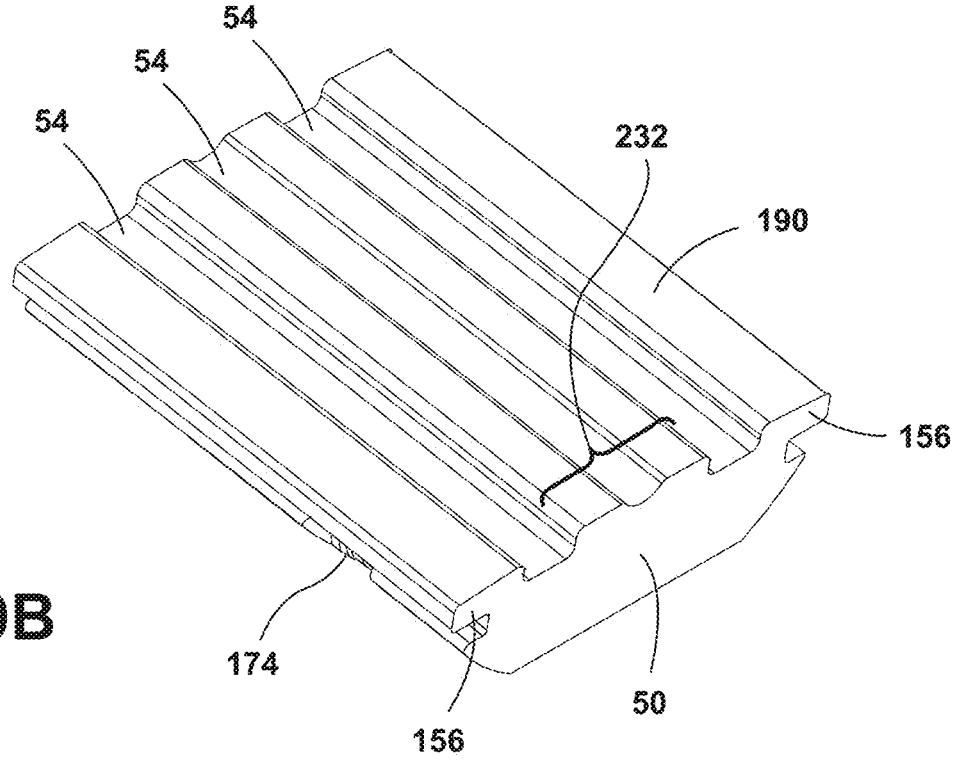
FIG. 9B is a top perspective view of the metal insert of FIG. 9A.
Figure 10:
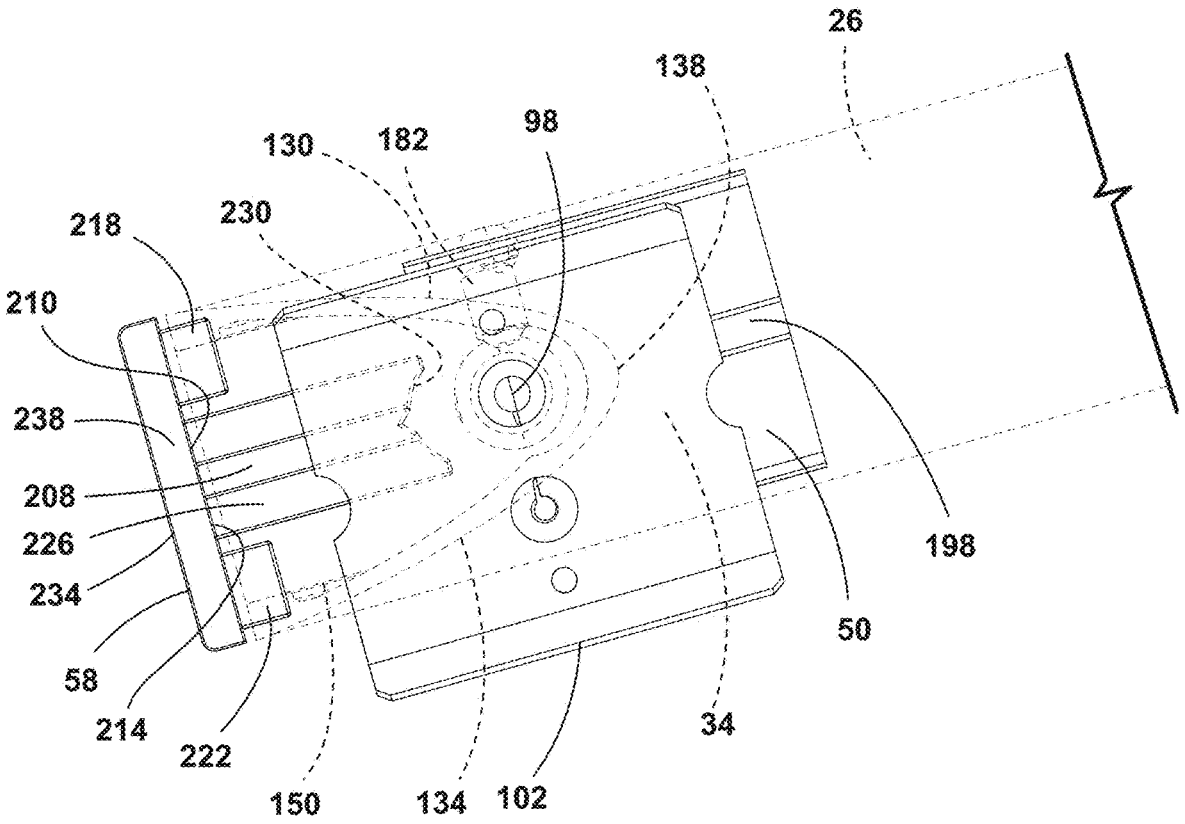
FIG. 10 is a partial enlarged view of a support plate and an end cap of the present disclosure with a body of a handle assembly in phantom.
Figure 11:
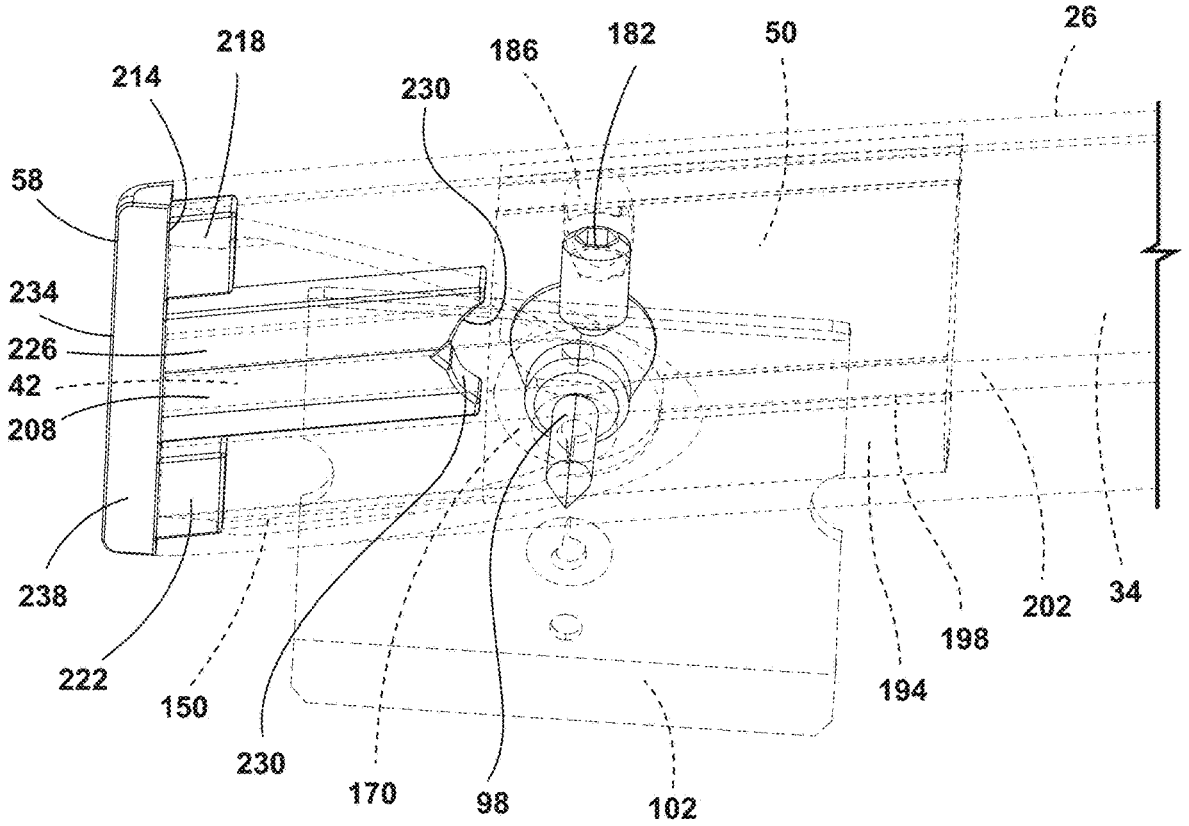
FIG. 11 is a partial enlarged side perspective view of an end cap of the present disclosure with a handle assembly, a metal bracket, and a support plate in phantom.
Figure 12:
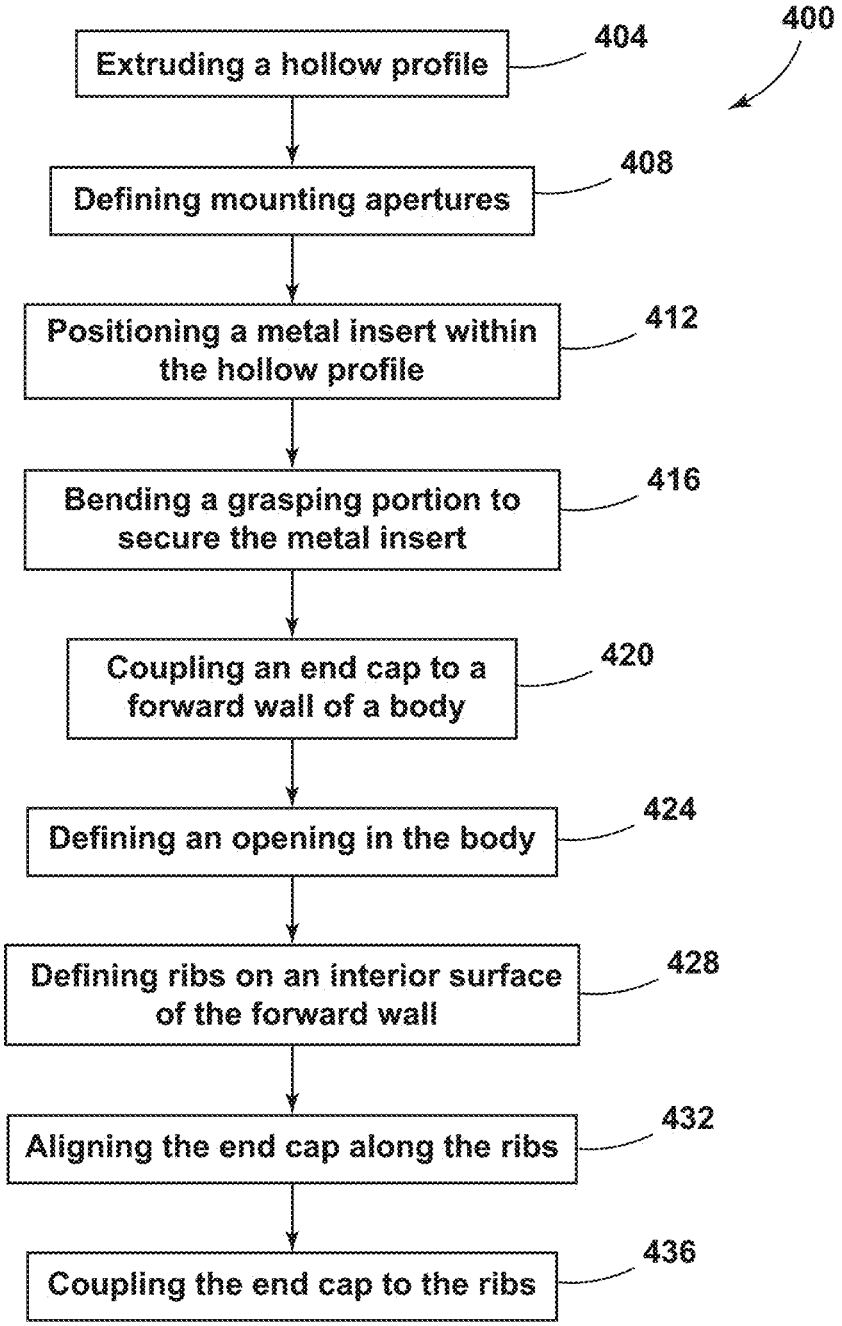
FIG. 12 is a flow diagram for a method of manufacturing a handle assembly of the present disclosure.

The metal insert 50 is positioned proximate to the arcuate feature 134 within the hollow profile 30 of the body 26. The metal insert 50 defines an inner mounting aperture 170 and a side mounting aperture 174, collectively mounting apertures 178. The apex 138 of the arcuate feature 134 partially frames the inner mounting aperture 170, such that the metal insert 50 is at least partially disposed beneath the grasping portion 34. The inner mounting aperture 170 receives one of the coupling features 98 that outwardly extends from the door 18 (FIG. 4). A fastener 182 extends into an opening 186 defined by the grasping portion 34 and is disposed within the side mounting aperture 174 of the metal insert 50. The fastener 182 engages the coupling feature 98 to further secure the handle assembly 22 to the door 18. In addition, the fastener 182 couples the metal insert 50 to the grasping portion 34 so the metal insert 50 is coupled to both the forward wall 38 and the grasping portion 34 of the body 26. Stated differently, the fastener 182 extends through the opening 186 in either the first or second side 118, 122 of the body 26 to couple the grasping portion 34 to the metal insert 50. In addition, the grasping portion 34 can be bent against the metal insert 50 to further secure the metal insert 50 within the hollow profile 30, such that frictional engagement couples the metal insert 50 to the body 26. Additionally, the flanges 156 that extend into the grooves 154 further retain the metal insert 50 within the hollow profile 30.

To create a supportive engagement, the slots 54 of the metal insert 50 are positioned over the ribs 42 defined by an interior surface 46 of the forward wall 38 so the metal insert 50 can be correctly positioned within the hollow profile 30. The fit of the ribs 42 within the slots 54 minimizes potential shifting movement of the metal insert 50 within the hollow profile 30. The slots 54 are defined on a support surface 190 of the metal insert 50, such that if a force is applied to the forward wall 38 near one of the opposing ends 126 of the handle assembly 22, the support surface 190 at least partially distributes the force applied over a large area. The metal insert 50 also has an engagement surface 194 which defines a channel 198 that can engage a support rib 202 defined by the grasping portion 34. Thus, when a pulling force is exerted on the grasping portion 34, the pulling force is at least partially spread across the engagement surface 194 along the grasping portion 34 rather than localized at a particular point. Additionally, the metal insert 50 is generally formed to follow a similar curvature of the grasping portion 34 to provide additional structural support.

Referring to FIGS. 6, 7, 10, and 11, the end cap 58 is positioned within the hollow profile 30 and is coupled to the interior surface 46 of the forward wall 38 of the body 26. Once positioned within the hollow profile 30, the end cap 58 and the arcuate feature 134 define the attachment portion 206 (FIG. 5) where the handle assembly 22 is coupled to the door 18 (FIG. 4). An elongated notch 208 is defined by the end cap 58 and is disposed over and coupled to one of the ribs 42 of the forward wall 38. In addition, a retention feature 210 extends from a proximal edge 214 of the end cap 58 toward the apex 138 of the arcuate feature 134. The proximal edge 214 is defined as the edge closest to the body 26. As depicted, the retention feature 210 includes three planar portions extending toward the arcuate central portion 114 (FIG. 5) of the body 26. The retention feature 210 extends beneath the extensions 146 of the base 142 of the arcuate feature 134. Thus, the retention feature 210 is coupled to the arcuate feature 134 beneath the extensions 146 and the forward wall 38 by the elongated notch 208 coupled to the ribs 42.

The retention feature 210 of the end cap 58 may include first and second projections 218, 222 that extend along the first and second sides 118, 122 of the body 26, respectively. The first and second projections 218, 222 are positioned beneath the extensions 146 of the base 142 of the arcuate feature 134. In addition, the first and second projections 218, 222 inwardly extend beneath the ledge 150 toward the arcuate central portion 114 (FIG. 5) of the body 26. The retention feature 210 further includes an elongated feature 226 on which the elongated notch 208 of the end cap 58 is defined. The elongated feature 226 may further define a locating recess 230 configured to align the end cap 58 relative to the metal insert 50, such that the elongated feature 226 may abut the metal insert 50. By way of example, not limitation, the metal insert 50 may have a locating feature 232 that may be at least partially received by the locating recess 230 of the elongated feature 226 to align the end cap 58 with the metal insert 50. The first and second projections 218, 222 and the elongated feature 226 of the retention feature 210 extend from the proximal edge 214 of the end cap 58 toward the arcuate feature 134.

A distal edge 234 of the end cap 58 is generally orthogonal relative to the oblique orientation 130 of the arcuate feature 134 and corresponds to a terminal end 238 of the end cap 58. The terminal end 238 extends between the outer wrapper 90 (FIG. 1) of the cabinet 14 (FIG. 1) and the forward wall 38 of the handle assembly 22. In addition, the terminal end 238 extends orthogonally relative to the length L (FIG. 5) of the body 26, such that each of the opposing ends 126 of the handle assembly 22 terminates at the terminal end 238. The end cap 58 tapers from the proximal edge 214 to the distal edge 234 terminating at the terminal end 238 in a similar manner as the oblique orientation 130 of the arcuate feature 134. Stated differently, the proximal edge 214 is raised slightly relative to the distal edge 234 of the end cap 58. As mentioned above, the end cap 58 can be inserted into the hollow profile 30 of the body 26 beneath the extensions 146 of the arcuate feature 134. The first and second projections 218, 222 engage the extensions 146 of the arcuate feature 134 during the opening and closing of the door 18 (FIG. 4). Thus, when a pulling force is applied to the handle assembly 22, the end cap 58 may at least partially engage the door 18 (FIG. 4). Although depicted as first and second projections 218, 222 and the elongated feature 226, the retention feature 210 is also contemplated to have a single protrusion extending into the hollow profile 30 of the body 26. In either construction, the retention feature 210 defines the elongated notch 208 to engage the ribs 42 to secure the end cap 58 to the interior surface 46 of the forward wall 38.

Referring again to FIGS. 1-12, a method (400) for manufacturing the handle assembly 22 for the appliance 10 includes extruding the hollow profile 30 from the body 26 of the handle assembly 22 to define the forward wall 38 and the grasping portion 34 (step 404). The mounting apertures 178 are defined within the metal insert 50 (step 408), and the metal insert 50 is positioned within the hollow profile 30 of the body 26 (step 412). The grasping portion 34 of the body 26 is bent to at least partially secure the metal insert 50 (step 416). The end cap 58 is coupled to the forward wall 38 of the body 26 (step 420). An opening 186 is defined in the body 26 of the handle assembly 22 and corresponds to at least one of the mounting apertures 178 that is defined by the metal insert 50 (step 424). During the extrusion process of the hollow profile 30, the ribs 42 are defined on the interior surface 46 of the forward wall 38 of the body 26 (step 428). In addition, the end cap 58 is aligned along the ribs 42 defined by the forward wall 38 (step 432), and the end cap 58 is coupled to the ribs 42 (step 436).

The handle assembly 22 provides a hollow profile 30 that minimizes the weight and cost of production of the handle assembly 22. In addition, the metal insert 50 provides structural support for the body 26 as well as attachment support for coupling the handle assembly 22 to the door 18. It is generally advantageous that the grasping portion 34 is generally curved to help retain the metal insert 50 by bending the grasping portion 34 around the metal insert 50. In addition, the oblique orientation 130 of the arcuate feature 134 of the grasping portion 34 provides an even attachment portion 206 that otherwise would be offset due to the bowing of the body 26. Accordingly, the handle assembly 22 provides for an improved method of manufacture and overall an improved handle assembly 22 for an appliance.

The invention disclosed herein is further summarized in the following paragraphs and is further characterized by combinations of any and all of the various aspects described therein.

According to one aspect of the present disclosure, an appliance includes a cabinet. A door is coupled to the cabinet, and a handle assembly is coupled to the door. The handle assembly includes a body that defines a hollow profile and has a rear grasping portion and a forward wall. Ribs are defined on the forward wall within the body. A metal insert is disposed within the hollow profile of the body. The metal insert defines slots that are configured to receive the ribs. An end cap is operably coupled to the ribs.

According to another aspect, a grasping portion of a body is arcuate in shape and defines an oblique orientation relative to an end cap.

According to yet another aspect, an attachment portion is defined by a grasping portion of a body and an end cap. A handle assembly is coupled to a door at the attachment portion.

According to still another aspect, an end cap has a terminal end that extends between a door and a forward wall of a body and is orthogonal relative to a length of the body.

According to another aspect, an end cap has a proximal edge that is defined relative to a body and a distal edge. The end cap tapers from the proximal edge to the distal edge.

According to another aspect, a grasping portion of a body defines an arcuate feature having an apex that defines a mounting aperture.

According to another aspect, a metal insert is coupled to a body by frictional engagement with a grasping portion of the body.

According to another aspect of the present disclosure, a handle assembly for an appliance comprises a body that defines a length and has opposite ends, a grasping portion, and a forward wall. The body further defines a hollow profile of the handle assembly. A metal insert is disposed within the hollow profile. An end cap has a proximal edge that is defined relative to the body and a distal edge. The end cap is coupled to at least one of the opposing ends of the body. A terminal end extends along the distal edge of the end cap and orthogonal relative to the length of the body.

According to another aspect, an arcuate feature is defined on opposing ends of a body.

Each arcuate feature has an apex and a base.

According to still another aspect, each apex extends toward a central portion of a body and away from a terminal end.

According to yet another aspect, an end cap includes a retention feature that extends from a proximal edge toward an apex of an arcuate feature and is coupled to a forward wall of a body at the proximal edge.

According to another aspect, a forward wall of a body defines ribs and a retention feature of an end cap is coupled to ribs.

According to yet another aspect, a forward wall and grasping portion each bow along a length of a body.

According to another aspect, an attachment portion is defined by a grasping portion and an end cap.

According to another aspect, a metal insert defines an inner mounting aperture and a side mounting aperture. A body defines an opening aligned with a side mounting aperture.

According to another aspect, an arcuate feature has an apex proximate to a metal insert. The apex further defines an inner mounting aperture.

According to yet another aspect of the present disclosure, a method for manufacturing a handle assembly for an appliance includes extruding a hollow profile from a body of the handle assembly that defines a forward wall and a grasping portion. Mounting apertures are defined within a metal insert and the metal insert is positioned within the hollow profile of the body. The method further includes bending the grasping portion of the body to secure the metal insert and coupling an end to the forward wall of the hollow profile.

According to another aspect, a step of defining mounting apertures further includes defining an opening in a body of a handle assembly corresponding to at least one of the mounting apertures.

According to yet another aspect, a step of extruding a hollow profile further includes defining ribs on an interior surface of a forward wall of a body.

According to still another aspect, a step of coupling an end cap further includes aligning the end cap along ribs that define a forward wall of a body, and couple an end cap to the ribs.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A handle assembly for an appliance, comprising:

an elongate arcuate body that includes a grasping portion having a first internal support rib and a forward wall having a second internal support rib, the elongate arcuate body further defining a hollow profile;

an insert disposed within the hollow profile, the insert including at least one slot that receives at least one of the first internal support rib and the second internal support rib;

an end cap operably coupled to an end of the elongate arcuate body; and at least one groove defined at least in part by the forward wall.

2. The handle assembly of claim 1, wherein the at least one slot includes three parallel slots.

3. The handle assembly of claim 1, wherein an external surface of the forward wall includes a first texture and an external surface of the grasping portion includes a textured material that resists slipping.

4. The handle assembly of claim 1, wherein ledges extend along an inside surface of the forward wall.

5. The handle assembly of claim 4, wherein the insert includes flanges that engage the ledges of the forward wall.

6. The handle assembly of claim 1, wherein the insert includes an engagement surface defining a channel that engages the first internal support rib defined by the grasping portion.

7. The handle assembly of claim 1, wherein the end cap is positioned within the hollow profile and is coupled to an interior surface of the forward wall of the elongate arcuate body.

8. The handle assembly of claim 7, wherein a retention feature of the end cap includes first and second projections that extend along first and second sides of the elongate arcuate body, respectively.

9. The handle assembly of claim 1, wherein the grasping portion includes an arcuate feature that has an apex oriented toward an arcuate central portion of the elongate arcuate body.

10. An appliance, comprising:

a door; and a handle assembly coupled to the door, the handle assembly including:

a body defining a hollow profile and having a rear grasping portion and a forward wall, wherein a rib is defined on the forward wall within the body and a rib is defined on the rear grasping portion within the body;

a metal insert disposed within the hollow profile of the body, the metal insert defining slots configured to receive the ribs; and an end cap operably coupled to the ribs.

11. The appliance of claim 10, wherein the metal insert includes an engagement surface defining a channel that engages the rib defined by the rear grasping portion.

12. The appliance of claim 10, wherein the end cap is positioned within the hollow profile and is coupled to an interior surface of the forward wall of the body.

13. The appliance of claim 12, wherein a retention feature of the end cap includes first and second projections that extend along first and second sides of the body, respectively.

14. The appliance of claim 10, wherein the rear grasping portion includes an arcuate feature that has an apex oriented toward an arcuate central portion of the body.

15. A handle assembly for an appliance, comprising:

an elongate arcuate body that includes a grasping portion having an arcuate cross-section and a forward wall that together define a hollow profile, the elongate arcuate body further including a first end and a second end, wherein ledges extend along an inside surface of the forward wall;

an insert disposed at each of the first and second ends of the elongate arcuate body within the hollow profile; and an end cap operably coupled to each insert.

16. The handle assembly of claim 15, wherein an external surface of the forward wall includes a first texture and an external surface of the grasping portion includes a textured material that resists slipping.

17. The handle assembly of claim 15, wherein the insert includes flanges that engage the ledges of the forward wall.

18. The handle assembly of claim 15, wherein the end cap is positioned within the hollow profile and is coupled to the inside surface of the forward wall of the elongate arcuate body.

* * * * *